US011913364B2

(12) United States Patent
Woelfling et al.

(10) Patent No.: US 11,913,364 B2
(45) Date of Patent: Feb. 27, 2024

(54) METHOD FOR MONITORING AN EMISSION LEVEL IN A VEHICLE

(71) Applicant: Robert Bosch GmbH, Stuttgart (DE)

(72) Inventors: Jurij Woelfling, Bietigheim-Bissingen (DE); Roberto Verrino, Stuttgart (DE); Timm Hollmann, Benningen A.N. (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/868,844

(22) Filed: Jul. 20, 2022

(65) Prior Publication Data

US 2023/0024848 A1 Jan. 26, 2023

(30) Foreign Application Priority Data

Jul. 20, 2021 (DE) ..... 102021207718.8

(51) Int. Cl.
*F01N 11/00* (2006.01)

(52) U.S. Cl.
CPC ..... *F01N 11/00* (2013.01); *F01N 2900/0418* (2013.01); *F01N 2900/0422* (2013.01); *F01N 2900/06* (2013.01); *F01N 2900/102* (2013.01); *F01N 2900/1402* (2013.01)

(58) Field of Classification Search
CPC ..... F01N 11/00; F01N 2900/0418; F01N 2900/0422; F01N 2900/06; F01N 2900/102; F01N 2900/1402
See application file for complete search history.

(56) References Cited

U.S. PATENT DOCUMENTS 10,711,714 B2 * 7/2020 Herbst ..... F02D 41/1444
2017/0067384 A1 * 3/2017 Müller ..... F01N 3/023
2017/0356362 A1 * 12/2017 MacEwen ..... F02D 41/009
2019/0227043 A1 * 7/2019 Jackson ..... F01N 9/00
(Continued)

FOREIGN PATENT DOCUMENTS

AT 517399 A1 1/2017
CN 102767413 A * 11/2012 ..... F01N 11/00
(Continued)

OTHER PUBLICATIONS

Machine Translation of CN 102767413 A (Year: 2012).*

*Primary Examiner* — Brandon D Lee
(74) *Attorney, Agent, or Firm* — Michael Best & Friedrich LLP

(57) ABSTRACT

A method for monitoring emissions in the exhaust gas of an internal combustion engine in a vehicle, comprising carrying out (520) multiple successive emission measurements for at least one component in the exhaust gas, wherein each of the emission measurements is respectively performed after a driving distance of predefined length is covered by the vehicle; storing (540) a distance-related emission value ($E_i$), which was obtained (530) on the basis of the measurement, in a memory element (42, 200, 400) for each of the emission measurements; and forming (550) a smoothed emission level for a current point in time on the basis of multiple of the previously stored distance-related emission values, wherein more recent emission values are taken into consideration more strongly than emission values lying farther back in time in the formation of the smoothed emission level.

18 Claims, 5 Drawing Sheets

(56) References Cited

U.S. PATENT DOCUMENTS

| | | | | |
|---|---|---|---|---|
| 2020/0025056 | A1* | 1/2020 | Bagnasco | F02D 41/1456 |
| 2020/0175787 | A1* | 6/2020 | Gortsas | G07C 5/10 |
| 2020/0191038 | A1* | 6/2020 | Grana | F01N 3/2066 |

FOREIGN PATENT DOCUMENTS

| | | | |
|---|---|---|---|
| DE | 102017223209 | A1 | 6/2019 |
| DE | 102018213076 | A1 | 2/2020 |

* cited by examiner

METHOD FOR MONITORING AN EMISSION LEVEL IN A VEHICLE

BACKGROUND OF THE INVENTION

The present invention relates to a method for monitoring an emission level in a vehicle and a computing unit and a computer program for carrying out the method.

In vehicles having internal combustion engines, the occurring emissions are continuously monitored and checked for the adherence to limiting values. This applies to all occurring emissions, thus, for example, for nitrogen oxides (NOx), carbon monoxide (CO), ammonia ($NH_3$), or soot particles. Various measures for reducing the emissions can then be initiated as needed by a controller on the basis of the measured parameters.

The emission values to be studied and the overall driven distance are each integrated over time and then the two integrated results are divided by one another to determine the currently occurring emissions per kilometer. The longer this distance or the observed time interval is, the less current emissions act on this emission mean value. Since the emission mean value is in turn used for the control, this has the result that with equal current emission values, the measures for emission reduction can have very different results. This difference is also referred to as the "memory effect" or "savings bank effect".

SUMMARY OF THE INVENTION

According to the invention, a method for monitoring emissions in the exhaust gas of an internal combustion engine in a vehicle and a computing unit and a computer program for carrying out the method.

The invention provides improved emission monitoring and control in vehicles having internal combustion engines. This is achieved by avoiding the memory effect by weighting measured emissions as a function of how far in the past they lie, so that an assessed emission level is independent of the length of the overall driving distance.

In particular, a method is proposed in which multiple successive emission measurements are carried out for at least one component in the exhaust gas, wherein each of the emission measurements is carried out after a driving distance of predefined length is covered by the vehicle. For each of these emission measurements, a distance-related emission value which was obtained on the basis of these measurements is stored in a memory element. A smoothed emission level for a current point in time is then formed on the basis of multiple of these stored distance-related emission values, wherein more recent emission values are taken into consideration more strongly for this purpose than emission values lying farther back in time. The distance-related emission values can be calculated on the basis of the measurements, for example, by intermediate steps such as integration over the driving distance or the time required for the driving distance. The driving distance of predefined length is preferably to be of equal length for each of the emission amounts.

Due to the reference of the emission values to the covered individual driving distance segments of equal length and due to the smoothing with stronger assessment of more recent values, new emissions can be assessed equally over the entire driven distance of a vehicle. In this way, the memory effect is prevented. Identical current emission events can thus result in comparable measures for emission reduction, independently of the already covered overall driven distance, and it is possible to react earlier and more clearly to current emission events.

In one possible embodiment, after each individual emission measurement, a new smoothed emission level can be formed for the current point in time. In each case a new measured emission value can thus be incorporated into the new smoothing and thus enable adequate consideration of current emissions. In principle, however, less frequent calculations of the smoothed emission values could also take place.

The formation of a smoothed emission level from multiple preceding emission values is to be understood broadly and can take place in various ways. For example, the formation of a smoothed emission level can comprise the formation of a moving weighted mean value from a predetermined number of most recently stored distance-related emission values. A moving mean value can preferably be applied so that the same number of emission values is always incorporated in the mean value, and thus the oldest value is replaced by a new emission value by each measurement. An emission level is thus obtained which is essentially determined by more recent emission events and in which large peaks are nonetheless smoothed by the mean value formation. The weighted moving mean value relates to the predetermined driving distance length and calculates a weighted mean value of the emissions per route distance within this. Due to the weighting, strong jumps in the emission level are avoided even if a high emission value is exceeded and nearly continuous emission level profiles are guaranteed.

In one possible embodiment, all of the predetermined number of emission values can be weighted equally in the formation of the moving weighted mean value. Equal weighting of all values using a weighting factor of 1 corresponds to a moving simple mean value. Very old values are no longer incorporated in the mean value due to the moving window, so that the desired stronger consideration of more recent emission values takes place automatically. Alternatively, the emission values can also be weighted differently in the moving mean value. Preferably, a chronologically progressive weighting can be selected, in which more recent emission values are weighted using a greater weighting factor than older emission values. A higher dynamic response of the monitoring method in relation to individual strong emission increases is achieved via a progressive weighting of the elements.

A further possibility for the formation of a smoothed emission level for the current point in time is the use of an exponential smoothing, in which the values are summed using a weighting in the form of an exponential series and as a function of a fixed smoothing factor between 0 and 1. The influence of older emission values then sinks very quickly due to the exponential weighting factors, so that again the more recent emission values decisively contribute to the smoothed emission level. In addition, a smoothed emission level on this basis can be formed for a current point in time very easily from the smoothed emission level of a prior pass and the most recent emission value, so that it is not necessary to store all previous emission values and the computing operations are significantly simplified.

In all possible embodiments, the smoothed emission levels obtained can subsequently be used further, for example, to decide about the initiation of emission-reducing measures. For this purpose, it can be checked whether a current smoothed emission level exceeds one or more threshold values, and if this is the case, emission-reducing measures can be initiated. Additionally or alternatively, it is also possible that depending on a smoothed emission level, for example, parameters of the emission measurements such as the measurement frequency, the selection of weighting factors or smoothing factors, or the number of values which are incorporated in a mean value are changed.

To store the emission values, for example, a memory structure having a fixed number of data elements can be used, wherein if all data elements are occupied, the respective oldest emission value in the memory structure is overwritten upon storage of a new emission value. Such a memory is also referred to as a ring memory and offers a particularly simple implementation for the above-mentioned features, for example, for calculating a moving average. Older emission values are automatically overwritten by newer emission values by the type of the storage in the ring memory. In principle, however, other logical memory structures are also possible for the temporary or permanent storage of emission values.

The number of the data elements in the memory structure, thus, for example, in the ring memory, can be greater than or equal to a number of stored emission values, from which the smoothed emission level for a current point in time is formed. For example, in each case the mean value can be formed over all elements stored in the memory structure, so that a continuously moving window for a mean value formation can be automatically defined. Alternatively, however, only a part of the stored values can be used, wherein it can optionally be changed in the course of the method how many of the stored emission values are used for the formation of the smoothed emission level.

If a ring memory or similar structure is used, a method-related undershoot of high-emission distance sections can optionally be prevented by an overflow mechanism. For this purpose, if the smoothed emission level exceeds a predetermined threshold value, the oldest emission value in the memory structure can be transferred into an additional buffer memory before this data element is overwritten by the storage of a new emission value. These steps can also be carried out multiple times if a threshold value is exceeded repeatedly. Preferably, the values which are additionally stored in the buffer memory can then also be used together with the elements in the ring memory for the formation of the smoothed emission level. It is thus possible to prevent a high emission level from being smoothed too quickly and thus possibly required measures not being carried out.

The described method steps and modifications can be used in principle for measuring and monitoring arbitrary emission values. In possible embodiments, the measurements can comprise, for example, the measurement of a concentration or an amount of at least one component in the exhaust gas, such as a concentration or amount of nitrogen oxides (NOx), ammonia ($NH_3$), carbon monoxide (CO), or an amount of particles.

A computing unit according to the invention, for example, a controller of a motor vehicle, is configured, in particular by programming, to carry out a method according to the invention.

The implementation of a method according to the invention in the form of a computer program or computer program product having program code for carrying out all method steps is also advantageous, since this causes particularly low costs, in particular if an executing controller is also used for further tasks and is therefore provided in any case. Finally, a machine-readable storage medium is provided having a computer program stored thereon as described above. Suitable storage media or data carriers for providing the computer program are in particular magnetic, optical, and electrical memories, e.g., hard drives, flash memories, EEPROMs, DVDs, and the like. A download of a program via computer networks (Internet, intranet, etc.) is also possible. Such a download can take place in a wired or wireless manner (e.g., via a WLAN network, a 3G, 4G, 5G, or 6G connection, etc.).

BRIEF DESCRIPTION OF THE DRAWINGS

Further advantages and embodiments of the invention result from the description and the appended drawings.

The invention is schematically illustrated on the basis of exemplary embodiments and is described hereinafter with reference to the drawings.

DETAILED DESCRIPTION

Figure 1:
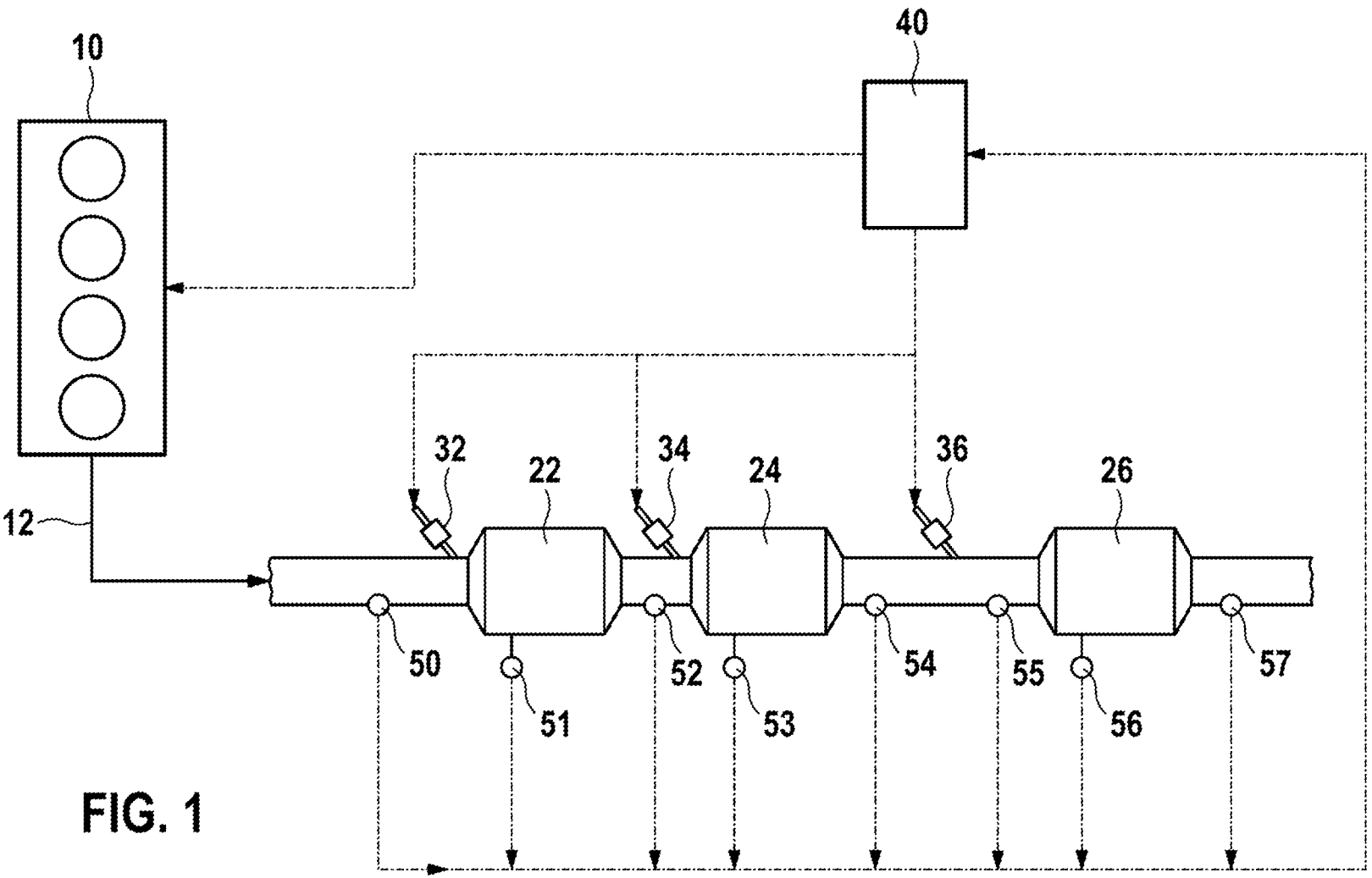
FIG. 1 sketches an internal combustion engine having exhaust train, in which embodiments of the invention can be applied.

FIG. 1 sketches an exemplary exhaust system having a gasoline engine, in which embodiments of the invention can be applied. An internal combustion engine 10 having four combustion chambers is shown, the exhaust gas flow 12 of which is introduced into an exhaust train. Various catalytic converters, filters, or other elements for exhaust gas treatment can be provided in the exhaust train, through which the exhaust gas is conducted in succession. For example, two three-way catalytic converters 22 and 24 can be provided, by means of which carbon monoxide, nitrogen oxides, and hydrocarbons are to be removed from the exhaust gas. A particle filter 26 can be provided adjoining thereon, such as a wall-flow filter. At various points 32, 34, 36, it can be reasonable or necessary for the exhaust gas treatment to introduce additives such as a reducing agent into the exhaust gas flow. Further modules can also be provided, such as secondary air supply lines, exhaust gas burners, electrical heating elements, or others. In particular electrical heating elements can also be arranged directly in the catalytic converter or inside a housing of the catalytic converter. These and other modules can be actuated and regulated by the control unit 40, wherein it can be a central engine controller or also another controller.

In addition, different sensors 50 to 57 are attached at various points in the exhaust system, which can measure parameters in the exhaust gas flow. The sensors shown in the figure are only arranged by way of example, can comprise multiple different sensors, and can be supplemented by further sensors, or sensors can be omitted or replaced by other ones. Thus, lambda sensors 50, 52, which can also be embodied, for example, depending on the use as broadband lambda sensors or switching-type lambda sensors, are typically located before each of the three-way catalytic converters to detect the oxygen concentration in the exhaust gas. Inferences about other exhaust gas parameters and the efficiency of the combustion can also be drawn from the measured value. Temperature sensors can be provided before and/or after each of the catalytic converters 22, 24 and also before and/or after a particle filter 26; alternatively, the temperature can also be measured (51, 53, 56) directly in a catalytic converter or filter. A pressure measurement is often performed in particular before 55 and after 57 a particle filter, alternatively also as a direct measurement of the differential pressure across the filter, but can also be provided at other points (for example, sensors 50, 52) in the exhaust train. Airflow meters 50 are used to detect the exhaust gas mass flow before a catalytic converter, but can also be attached at further locations.

In alternative embodiments, the following steps could also be used for an exhaust system of a diesel engine, wherein then, for example, an oxidation catalytic converter, an SCR catalytic converter, and a particle filter can be provided and respective corresponding sensors can detect the exhaust gas parameters.

Direct emission values which are of interest for the control and regulation, such as the concentrations of nitrogen oxides (NOx), ammonia ($NH_3$), carbon monoxide (CO), and the amount of particles are in particular measured by sensors 57 at the end of the exhaust train after the exhaust gas treatment to establish how high the emission load is in the emitted exhaust gas. Gas sensors can be used for this purpose, for example, a NOx sensor having cross sensitivity to ammonia or a multigas sensor.

Various parameters or components of the exhaust gas in the exhaust gas system can thus be measured continuously or at time intervals via these sensors 57. These measurements are referred to hereinafter as emission measurements. As shown, exhaust gas parameters can both be measured in the exhaust gas directly after the internal combustion engine and also after a part or all exhaust gas-purifying elements of the exhaust train, thus, for example, before and/or after a particle filter, before and/or after a catalytic converter. Various measured parameters can also be combined with one another or used further in calculations and models as emission measurements in the broader meaning. For example, temperatures at various locations in the exhaust train, an oxygen concentration in the exhaust gas, an exhaust gas mass flow, a differential pressure across a particle filter, or other measured values can also be detected, which do not directly indicate the amount of an exhaust gas component, but can contribute to ascertaining such emission values. Directly measured emissions can also be corrected or converted on the basis of such additional measured parameters, such as temperature or pressure, to form emission values for the control.

The elements for exhaust gas treatment shown and described here as well as the sensors and metering modules are only mentioned by way of example. The present invention is suitable, however, for arbitrary vehicles having an internal combustion engine and is not restricted to a specific embodiment of the exhaust train or to specific exhaust gas components or specific measurements. Rather, the following embodiments can be applied to all emission parameters which are measured in the exhaust gas at an arbitrary suitable point and the emission level of which is evaluated in any way for the further control and regulation of the system.

The measured values can be transferred to a controller, where they can be processed and/or passed on in various ways. In addition, the values can be stored before further processing or subsequently in a memory element. The control software can comprise various packets which model or control the behavior of individual parts of the vehicle systems and can communicate with one another and can receive data from other elements or send data thereto.

Figure 2:
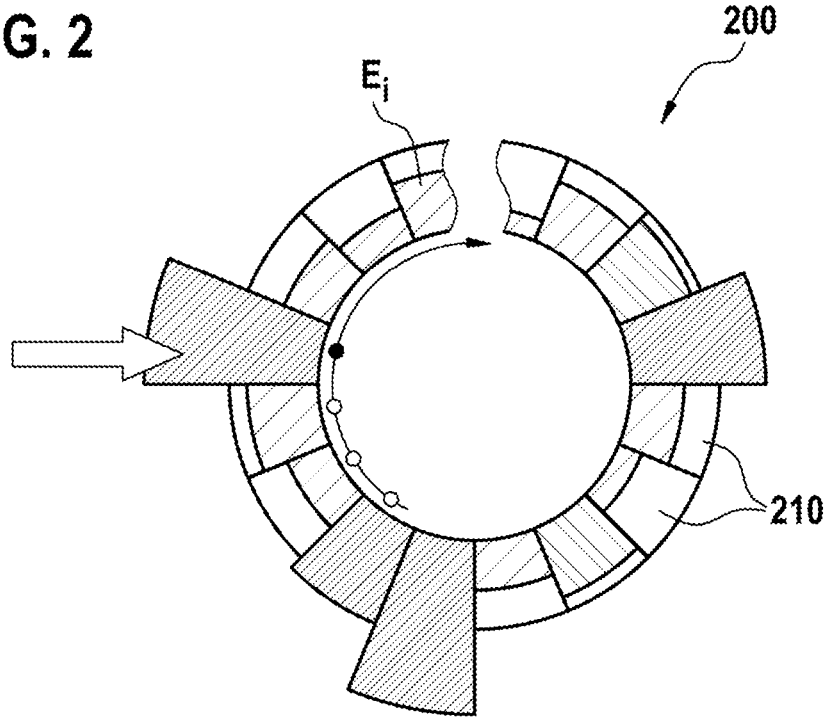
FIG. 2 shows a schematic diagram for a ring memory according to one embodiment of the invention.

According to one exemplary embodiment of the invention, which is described in conjunction with FIG. 2, at least one exhaust gas parameter is measured multiple times and the result of the measurement is stored. Any arbitrary emission parameter that is measurable or ascertainable on the basis of measurements can be used, the values of which are typically used for monitoring and actuating functions in the vehicle. A value for a driving distance b is predetermined, after which the exhaust gas parameter of interest is to be measured or ascertained in each case. This driving distance b for a covered distance segment initially remains equal for each measurement, so that an emission measurement is performed in uniform distance intervals and the results are each stored in a memory element. Subsequently, a specific number of preceding measurement results or emission values is used to form a mean value. It is obvious that not only the direct measured values can be used and stored, but also a processed measured value. For example, in the present method a punctiform measured value for an exhaust gas component, which is measured as a mass unit per time, is to be integrated over time. The time period over which the emission value is integrated results from the time ti, which the vehicle requires for driving along the distance segment. For this purpose, for example, the driving speed can also be continuously integrated over time, so that the distance traveled up to this point in the current distance section results. When this distance has reached the defined length b, this integrated emission value (mass) or the value normed to the distance length (mass/length) can then be stored as the distance-related emission value for this distance segment.

The respectively covered driving distance can alternatively or additionally also be determined here by a simple odometer, but can also, for example, be supplemented or replaced by other position determination methods, such as GPS data.

One possible implementation of this method uses a ring memory, thus a memory in which multiple data elements are stored in succession, wherein after a specific number of written data elements, these are overwritten again. Preferably, the oldest provided data element is overwritten by a new data element in each case. This memory principle can be graphically represented by a ring having multiple elements.

FIG. 2 schematically shows such a ring memory 200 having n ring segments 210 to represent the memory elements, wherein n indicates the number of the storable data elements after which the first data element is typically overwritten again by a new data element. Thus, for example, to write the (n+1)th data element in a ring memory having n segments, the first data element is overwritten again. It is obvious that this depiction only illustrates a logical memory structure and does not have to correspond to an actual arrangement of elements.

A distance-related emission value $E_i$ for a covered distance segment of the length b is stored in each memory element 210 of the ring memory 200. The emission values are represented in FIG. 2 by the shaded regions in the respective circle segments, wherein the arrow indicates the current write position in the ring memory. In principle the direct measured value of an emission measurement could be stored as the emission value; however, the measured value can also be changed beforehand by computing operations or by combination with other values and the result can first be stored as the emission value in the ring memory. For example, after covering a defined distance b in a time $t_b$, a measured value for an emission parameter, such as the nitrogen oxide concentration NOx in the exhaust gas after the catalytic converters, can be detected by a suitable sensor. For this purpose, for example, the nitrogen oxide concentration can be measured in ppm, converted via the exhaust gas flow rate into mg/s, and then integrated over the driving time $t_b$ required for the distance segment. The driving speed can be integrated continuously over the distance for this purpose; as soon as this distance value has reached the defined length b of a distance segment, the also integrated emission value for this driving segment can be stored. Emission values are thus obtained $$E_i\left[\frac{\text{mg}}{\text{km}}\right] = \frac{1}{b}\int_t^{t+t(b)} NOx\left[\frac{\text{mg}}{s}\right]dt,$$

which are subsequently stored for this driving segment in the ring memory. Subsequently, after again covering a further distance segment of the length b, a further measurement is performed and a further emission value is formed. For this purpose, the integrators are each reset to 0 between the distance segments. The parameter NOx is only mentioned as an example and can be replaced by other emission parameters.

In this example, the value thus integrated is to be stored as an emission value. The units used can also be selected differently than in this example, of course, as they are reasonable for the respective measurement or control.

After each measurement, a weighted mean value is then formed over a specific fixed number k of previously stored emission values, so that a moving mean value is obtained. In the simplest case, this mean value can be formed over all n emission values present in the memory, thus k=n. However, it is also possible that the size of the ring memory (or the number of the assigned memory elements) is greater than the number of the emission values which is normally used to form the mean value. A number k can then be defined, which determines how many of the preceding emission values are used for the mean value formation. This number k can be permanently predetermined in the measurement method and equal in all driving situations, so that, for example, a ring memory having n=24 memory spaces could be used, while normally only the last k=12 stored emission values are used for a mean value formation. Alternatively, this number could also be selected differently in the course of the method, however, either in each case for a specific driving situation, or depending on other parameters of an engine controller. In other embodiments, the number k of the emission values $E_i$, which are used for the mean value formation, could also be selected directly depending on the emission values themselves or on one of the formed mean values. In this way, a moving mean value having dynamic window can be formed from the stored emission values; the section of data elements which are incorporated in the mean value formation is referred to as the window. The window width thus determines the number of the elements which are incorporated in the mean value. The maximum possible number of emission values which can be incorporated in the mean value can then be equal to the number n of storage spaces in the ring memory in this embodiment.

In alternative embodiments it is also possible not to create and check a new weighted mean value after each emission measurement or after each stored emission value, but only after each two or more measurements, for example, to reduce the required computing power. The ratio between the number of the stored measurements and the number or the points in time of the mean value formation can be permanently predetermined in the method. For example, it could be defined that a ring memory having 24 segments or stored data elements is used, but a mean value formation is also only performed after every third or fourth measurement and storage, in which all stored emission values or a part thereof can in turn be incorporated.

The formation of the mean value over the predefined number of emission values can be produced as the simplest variant by a simple mean value. All stored emission values (or as many emission values as are to be incorporated in the mean value) are thus summed and divided by the total distance length depicted in the ring memory, thus by the distance n·b if the entire ring memory is used, or k·b, if only a part k of the presently stored values is incorporated in the mean value. This corresponds to a weighted mean value in which the weight of each emission value is selected as equal to 1. If the entire ring memory is used to form the mean value, the simple mean value of the emission values thus results as $$M_s(s) = \sum_{i=1}^{n}\frac{E_i}{n\cdot b} = \sum_{i=1}^{n}\frac{\int_t^{t+t(b)} NOx_i dt_i}{n\cdot b}$$

wherein $M_s$ is the simple mean value, b is the defined length of the distance segment for each measurement, n is the number of the data elements in the ring memory, $NOx_i$ is in each case a measured value from a measurement of the NOx concentration in the exhaust gas, and $E_i$ is in each case an emission value stored in the ring memory.

It is to be noted here that in each case the last or most recently stored values are also to be incorporated in the mean value. If summing is performed over all elements of the memory, thus if k=n, all most recent values are automatically included in the sum. In contrast, if only a part of the elements in the ring memory is used for the mean value, the data elements are used backwards from the last written emission value. Thus, in a ring memory having 12 memory elements written in succession, if an emission value was last written in the third data element and in each case the most recent 6 elements are to be incorporated in a mean value, the sum is thus formed over the data elements 10 to 12 and 1 to 3.

Alternatively, a weighted mean value can be formed in which the stored emission values receive different weighting factors. In principle, the weighting factors can be selected freely. Preferably, a progressively weighted mean value can be formed, in which more recent measurements receive a higher weight than older measurements. There are also many different options here for how the weighting factors can be formed. For example, in a simple embodiment only two weighting factors could be provided, wherein the newer half of the stored emission values receives a higher weight, for example, twice as high as the older half of the stored emission values. Alternatively, however, a separate, different weighting factor can also be provided for each data element or each emission value. Fixed weighting factors stored for the method can be specified here, for example, which increase continuously from the oldest to the newest emission value. It is obvious that a single emission value is thus weighted strongest directly after its measurement and contributes increasingly less to the mean value in the later mean value formations. In this way, a higher dynamic response of the ring memory is achieved with respect to individual strong emission increases.

For the case in which the entire ring memory is again used for the mean value formation, a weighted mean value $M_w$ results in which each emission value $E_i$ is assigned a weighting factor $g_i$, thus $$M_w(s) = \sum_{i=1}^{n} \frac{g_i \cdot E_i}{n \cdot b} = \sum_{i=1}^{n} \frac{g_i \cdot \int_t^{t+t(b)} NOx_i dt_i}{n \cdot b}$$

As a further embodiment, instead of a progressively weighted mean value, an exponential smoothing of the distance-related emission values can be applied, which results in similar results. A weighting factor is assigned to each distance-related emission value here as a function of a smoothing factor α in an exponential series. The determination of the emission values can take place as already described above, in that the measured values are integrated over time and offset by the length of the distance segment.

Smoothed emission values $M_{exp}[z]$ thus result as $$M_{exp}[z] = \alpha \cdot E_z + \sum_{i=1}^{z} (1-\alpha)^i \cdot E_{z-i}$$

wherein $E_z$ is the last ascertained emission value at the current point in time z, while $E_1$ is the oldest emission value.

The smoothing factor or presence factor α determines here how strongly the individual elements are incorporated and how strongly the profile of the emission values is smoothed. In this case, α is to be between 0 and 1. At a presence factor α of 1, the obtained smoothed estimated value would precisely correspond to the last emission value $E_z$, since then the other values would no longer be incorporated. At a presence factor α of 0, all emission values except for the newest value would be incorporated. A suitable factor α between these extremes can thus be selected to weight the most recent emission values differently. The larger α, the more strongly the reference to the current values is in the calculation. As long as α>0.5 is selected, the most recent emission value is also the most strongly weighted. This factor can also be permanently specified for the method here or can change depending on specific conditions.

In principle, an exponential smoothing can also be used with a ring memory, in that only the emission values stored in the ring memory are summed using the respective smoothing factors. Since the influence of older values on the result decreases very quickly, older values can be neglected. At a smoothing factor of α=0.5, for example, the same weighting factor still results for the second most recent emission value as for the most recent emission value, while the weighting factor for the emission value before this is already only at 0.25. The tenth emission value before the current value already receives a weighting factor of $(1-\alpha)^{10} \cong 0.001$, so that the influence of even older values is practically negligible.

In an alternative embodiment, however, not all previous measured values or emission values have to be stored to ascertain the exponentially smoothed emission values; rather the most recent value can then be obtained in each case from the smoothed emission value of the prior step together with the most recent emission value, since the following applies $$M_{exp}[z] = \alpha \cdot E_z + M_{exp}[z-1](1-\alpha) = \alpha \cdot (E_z - M_{exp}[z-1]) + M_{exp}[z-1]$$

This variant can therefore be implemented particularly easily in that from the most recent emission value $E_z$ and a smoothed value $M_{exp}[z-1]$ last formed in the prior pass, which can be stored or buffered after its determination in a memory, for example, the next smoothed value $M_{exp}[z]$ is formed by a few computing steps as shown above. The memory and computing load is thus minimized.

This mean value or smoothed emission value formed from multiple emission values and thus for multiple distances of equal length can then be compared to one or more threshold values. The following steps can in turn be used with each of the described variants, thus both the simple mean value having weighting factor 1 and also with suitably weighted mean values or with the exponential smoothing. When reference is made in the examples to an emission mean value or mean value, the described steps can also always be applied accordingly to a value obtained by exponential smoothing. If a predetermined threshold value is exceeded, suitable measures for emission reduction can subsequently be initiated by a controller. These can comprise, for example, changes in the point in time and amount of the fuel injection, changes of the priorities of different control modules, the initiation of a regeneration of a particle filter, an overrun shutoff of the internal combustion engine, a temperature increase in the exhaust train, or a change of the urea injection for an SCR catalytic converter.

A maximum value can be defined for one or each emission component, which is preferably not to be exceeded on average and the exceeding of which initiates immediate active measures for emission reduction.

Multistep threshold values can optionally also be used, so that upon exceeding the lowest threshold value, for example, emission-reducing measures are not yet used, but more closely cycled emission measurements are performed, which can be achieved by changing the predefined distance b, after which a new measurement is to take place in each case. If a further, higher threshold value is exceeded, predefined active measures can then be initiated. It is also conceivable to classify the various measures which are available for the control of the emission reduction into various groups and to initiate the corresponding group of emission-reducing measures depending on which threshold value is exceeded by an emission mean value.

Alternatively or additionally, it can also be checked how several successively ascertained emission mean values behave in relation to one another. If, for example, very large variations occur in spite of the smoothing by the mean value formation, the frequency of the measurements can be increased by shortening the distance b defined for each segment. Alternatively or additionally, functional parameters such as the slope of a curve of formed mean values can also be observed, or, for example, a long-term mean value can also be additionally formed over an overall distance, which is significantly longer than the driving distance segments b. These results can also be used directly for the control of emission-reducing measures, but could also be incorporated in other areas of the vehicle control or stored for later readout.

The formed emission mean value can also be used for further definitions. For example, a dynamic window as described above can be defined, wherein the window width can be made dependent on the result of the mean value check or on the mean value itself. For example, it can be defined that if a limiting value is exceeded by the last determined mean value, the window width of the next mean value (thus the number k of the incorporated last emission values) is increased by a specific value.

In addition to the monitoring of the mean value or the smoothed emission level for exceeding threshold values, each individual emission value can already be checked for exceeding one threshold value or multiple threshold values. This threshold value can be identical to the threshold value which is used for the mean values, or a separate threshold value can be defined. This check for the individual measured values can also be incorporated in controls and further calculations or can trigger specific measures.

Figure 3A:
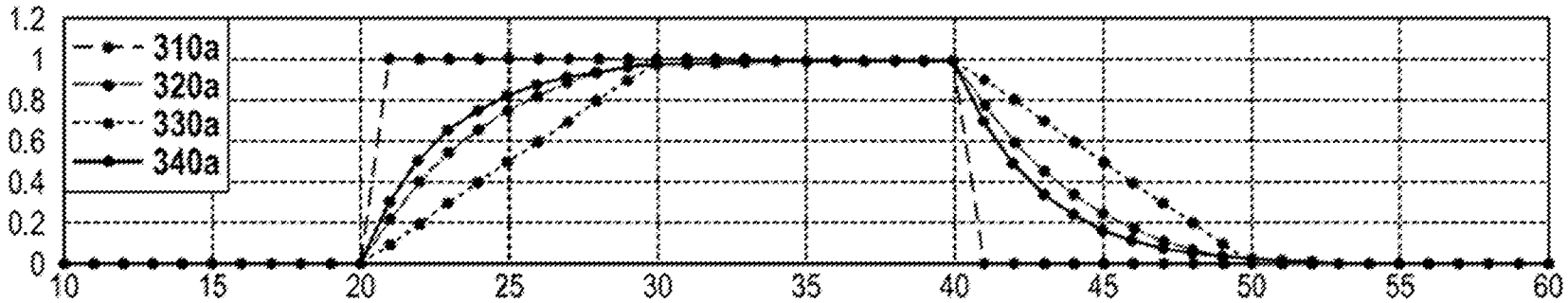
FIGS. 3*a* to 3*c* show various examples of measured emission values and mean values obtained therefrom according to various embodiments of the invention.

Examples of the effect of various methods according to the invention on the obtained emission levels are shown in FIG. 3. FIG. 3*a* shows normed emissions plotted against a driving distance in km. The individual data points correspond to the respective points in time of an emission measurement or mean value formation.

The stepped curve 310*a* shows the profile of the input values, thus the measured emission values. At a driving distance of 20 km, a strong sudden emission increase to the normed maximum value is shown, which then continues approximately 20 km further and is continuously measured in this level. Subsequently, the measured emission value falls back to 0 again, for example, due to an overrun shutoff. The three remaining curves in the first graph show which emission levels result by mean value formations from a predefined number of prior emission values according to various possible embodiments. The simple moving mean value in curve 320*a* results in a constant increase from the point at which the elevated emission value was measured. The slope of this curve is dependent on how many of the prior emission values are incorporated in the simple mean value formed. After the drop back to the emission value 0, a delayed, constant reduction thus also results. The curve 320*a* of the simple mean value then also reaches the value 0 when all emission values incorporated in the mean value are more recent than the last elevated emission value.

The curve 330*a* shows a weighted moving mean value, while curve 340*a* was obtained by an exponential smoothing of the input values. In contrast to the simple mean value, a faster increase results here in both cases in reaction to the elevated measured current emission value, and vice versa also a faster sinking of the smoothed emission level after the step back to the value 0.

Figure 3B:
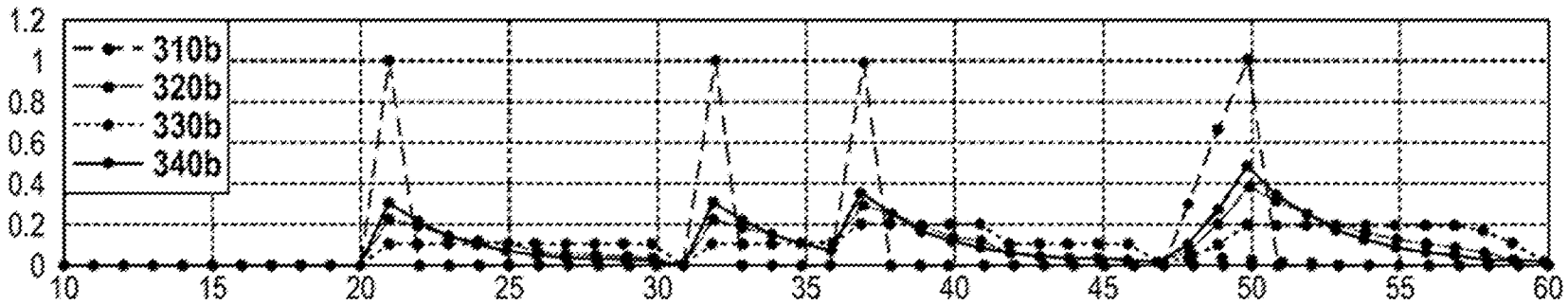

In FIG. 3*b*, measured emission values are again shown by the curve 310*b*, wherein individual high emission peaks are shown here, between which comparatively low emission values are measured. The curve 320*b* also initially shows the simple moving mean value here. The emission peaks are hardly visible and the entire curve is strongly smoothed in relation to the actual measured values. In contrast, the weighted mean value 330*b* and the exponential smoothing 340*b* still clearly show the emission peaks. In addition, these weighted mean values also sink somewhat more slowly after each emission peak than is reflected by the currently measured emission value.

Figure 3C:
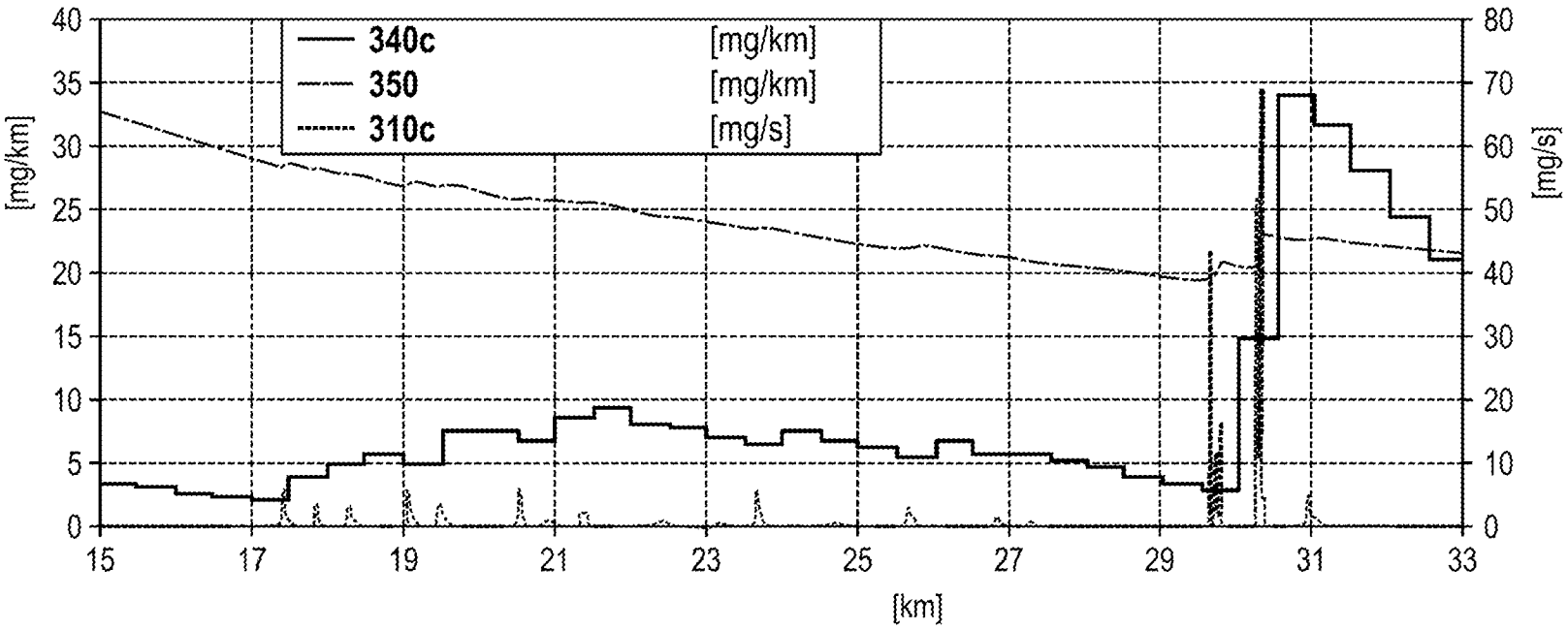

FIG. 3*c* also shows the emissions plotted against the covered overall distance in km plotted in a graph. Curve 310*c* shows the profile of the current emission values without averaging or integration, wherein the numeric values are indicated on the right y axis. These show emission peaks which become smaller and smaller and also larger (in the range between 29 and 30 km total driving distance). Curve 350 now shows the integrated emission value as is often used in the prior art. The previous emissions are integrated over the overall driving distance here. The punctiform elevated emission values only still result in very minor deflections and can thus also hardly excite emission-based measures or controls. In contrast, curve 340*c* shows an emission curve obtained by exponential smoothing of the emission values. This smoothing is capable of assessing the temporary emission increase significantly more strongly and thus also requesting an intervention of a higher-order emission-based regulator earlier. The exemplary numeric values for the smoothed or integrated emission values are plotted on the left y axis.

Figure 4:
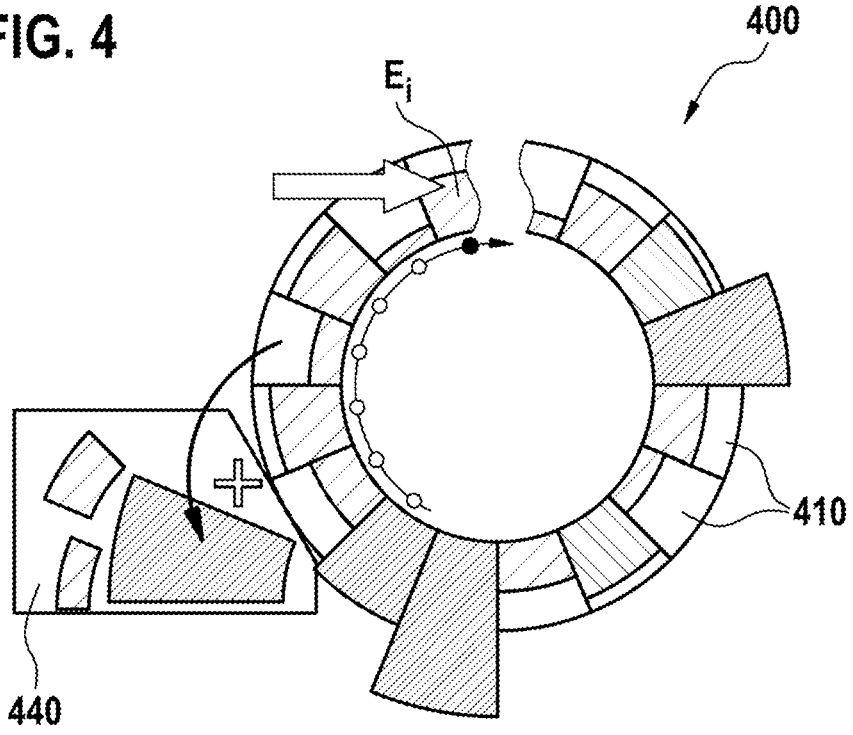
FIG. 4 schematically shows a further embodiment in which an additional buffer memory is used in addition to a ring memory.

FIG. 4 schematically illustrates a further embodiment using a ring memory 400 to form a weighted mean value, in which an additional logical memory area 440 or buffer memory is used. Like the ring memory 400, this can also be a volatile or nonvolatile memory. Thus, for example, the mean value formation can take place as described above over the emission values $E_i$ in the n segments 410 of the ring memory 400 and the mean value can subsequently be evaluated. The arrow again indicates the current memory position. If the current mean value exceeds a predetermined threshold value, it can optionally be defined that before a value in the ring memory 400 is overwritten, this emission value is read out and copied in a buffer memory 440. Only then is the data element in the ring memory overwritten by a new emission value. This can also take place multiple times as long as the emission mean values exceed a threshold value. In this way, in addition to the last n emission values in the ring memory, m older emission values are also stored in the buffer memory.

The next mean value is then to be formed combined from the n emission values in the ring memory 400 and the m emission values in the buffer memory 440, so that a mean value is thus formed from (n+m) stored emission values. Weighting factors can also be selected suitably here both for the emission values from the ring memory and also for the additional emission values from the buffer memory, preferably again with a chronologically progressive weighting, which results in stronger weighting of more recent emission values.

It can be defined here that after a predetermined threshold value is first exceeded, stored values in a ring memory element are copied into the buffer memory before the overwriting until one of the following newly calculated emission mean values falls below this threshold value again. Alternatively, another, second threshold value can also be specified for the falling below, which can be lower than the first threshold value, for example, from the exceeding of which the buffer memory is used.

After the associated threshold value is not reached, the following data are again written in the typical manner in the ring memory and the emission mean values are formed as previously only from the emission values in the ring memory.

For the implementation, for example, it could also be defined that the mean value calculation always uses all provided elements in the ring memory and in the buffer memory, thus (n+m) emission values, and that the buffer memory is erased when it is no longer necessary. In this way, it does not have to be checked separately before the mean value calculation which values also have to be incorporated; in standard operation the associated memory area in the buffer memory is then empty and the number m of the additional emission values is at 0. Alternatively or additionally, a counter can be used which indicates how many additional values in the buffer memory also have to be incorporated in the current mean value calculation.

In an alternative variant, new emission values could be written directly into the buffer memory when the threshold value is exceeded, so that overwriting the oldest data segments in the ring memory is initially prevented and the older emission values are retained in the ring memory. The mean value is also formed here over emission values from ring memory and buffer memory. As soon as the relevant threshold value is not reached again and only the ring memory is to be used, the elements of the buffer memory can be read out and written at the next point in the ring memory, wherein the oldest data elements in the ring memory are again each overwritten first. Subsequently, the next emission value ascertained by measurement is written at the following memory pointer in the ring memory.

Upon the return to the standard mean value calculation, in which only emission values from the ring memory are used, in one possible embodiment, the additional elements in the buffer memory can be immediately omitted in the next formed mean value. Alternatively, however, the number of the emission values used in the mean value could also be reduced step-by-step. If, for example, n emission values in the ring memory are normally used for the mean value formation and, due to exceeding the threshold value multiple times, m additional values are stored in the buffer memory and also incorporated, if the threshold value is not reached, initially only the oldest of the m emission values in the buffer memory can be omitted and/or erased, so that a mean value is formed over n+m−1 emission values. This can be continued until only the emission values in the ring memory are again still used.

The threshold value which triggers the use of a buffer memory can again only be a specifically used threshold value or a limiting value for the emissions, which is also used to control the emission-reducing measures.

Alternatively or additionally, other conditions can also be defined for the use of the additional buffer memory or in principle for the storage of further emission values, which are also incorporated in the mean value formation. For example, specific driving situations in which atypically low or atypically high emission levels are expected to occur for a limited phase could trigger the use of the buffer memory for a predefined time, for a predefined driving distance, for a predefined number of measurements, and/or until the end of the defined condition. For example, in the event of a particle filter regeneration, high particle values briefly occur in the exhaust gas. Various exhaust gas values also differ strongly from normal driving operation during startup. It is also possible to take into consideration such special driving situations in that under these conditions more frequent measurements are performed by shortening the defined driving distance segments b, in that the associated emission values are assigned other or additional weighting factors, or individual measured values are not taken into consideration at all as exceptions and are either weighted at 0 in the mean value formation or are not stored. This can also be used if measured values indicate a malfunction, for example.

If, in one possible embodiment, not all elements in the ring memory are normally used to form the emission mean value, a solution corresponding to the buffer memory can also be implemented, in that the number of the elements from the ring memory used for the mean value is increased as soon as a limiting value is exceeded. At a number of 24 stored emission values in the ring memory, for example, the last 12 emission values could normally be used for the mean value formation. However, as soon as the associated limiting value is exceeded, the number of the data elements used can be increased step-by-step. In the following mean value formation, a mean value can thus be formed over the preceding 13 emission values, and if the limiting value is then still exceeded, the next following mean value is formed from 14 emission values, etc. This again corresponds to a moving mean value formation having dynamic window, wherein the window width is increased on one side as soon as the calculated mean value exceeds a threshold value. An additional change upon storing the emission values or copying values into a buffer memory is not necessary in this embodiment, as long as sufficiently many additional, older measured values are stored in the ring memory.

Figure 5:
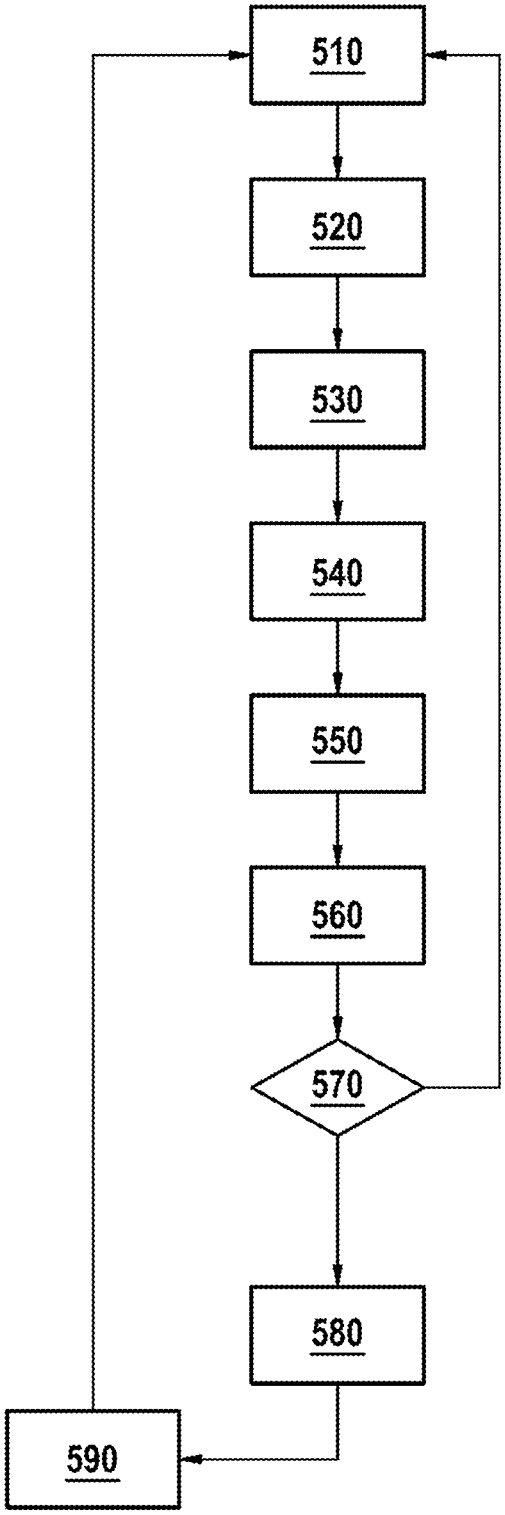
FIG. 5 shows a flow chart having exemplary method steps.

FIG. 5 once again shows by way of example method steps according to one embodiment of the invention. In step 510, the sequence first waits until the vehicle has covered a driving distance of defined length. After this driving distance, in step 520, an emission measurement is performed in the exhaust gas. The measured value can be further processed in step 530, for example, by a time integration over the driven distance segment b. Subsequently, the emission value thus obtained is stored in step 540 in a memory element, for example, in a ring memory as in the exemplary embodiment from FIG. 2. In step 550, a mean value or a smoothed estimated value is calculated from the values stored up to this point, as was described in detail in the preceding examples. This can be stored in step 560, in particular for the case of exponential smoothing. In step 570, the calculated mean value or smoothed estimated value is compared to at least one threshold value and it is checked whether this threshold value is exceeded. If a threshold value is exceeded, in step 580, emission-reducing measures can be initiated. Alternatively or additionally, the calculated value or a notification of exceeding the threshold value can also be transferred to another software or hardware module, where further steps can then be initiated. In step 590, the measurement and/or storage method for the emission values can optionally be adapted due to the threshold value being exceeded in step 570. Such an adaptation can comprise, for example, writing stored values in a buffer memory, adapting the window for the moving mean value, or increasing a measurement frequency, as was described in detail in the preceding examples. Subsequently, the method is repeated from step 510, in that the sequence waits out a further distance section having the defined length b and a new emission value is formed and stored, and a new mean value is produced and checked. Steps 580 and 590 do not have to be carried out in this sequence, but can also take place in parallel or in reverse. A new measurement and storage of emission values can also already be carried out over steps 510 and 520, for example, while the smoothed emission level is still calculated, stored, checked, or used for further measures in steps 550 to 590.

If it is established in step 570 that the threshold value is not exceeded by the currently formed mean value or smoothed value, steps 510 to 570 can be repeated directly without adaptations or changes.

It is obvious that the features and method steps mentioned in the preceding examples can also be combined with one another differently. For example, the statements for an additional buffer memory or for dynamic mean value windows can be combined with all arbitrary types of a mean value formation, thus, for example, with all weighted or non-weighted mean value methods. Individual options, such as the use of additional conditions or multistep and/or asymmetrical threshold values, the ratio of the number of mean value formations to the number of measurements, additional computing steps before the mean value formation, and further modifications can also be applied or omitted in each embodiment.

In each of the preceding examples, the measurement, mean value calculation or smoothing of the measured values, and checking of the averaged or smoothed values was described for a single emission parameter. Of course, multiple or all available emission parameters can also be evaluated in this way. The described methods can be applied independently of one another for each parameter. Alternatively, however, combined steps or conditions can also be used in the measurement and evaluation of multiple emission parameters. For example, for the case in which an elevated emission mean value was established for a first emission parameter, the measurement frequency or the number of the averaged emission values could also be increased for another emission parameter. This is advisable in particular if it is known that specific emission parameters mutually influence one another or are increased by similar conditions. It is also conceivable that threshold values or weightings which are used for a first emission parameter to evaluate the mean values are changed as a function of the evaluation results of a second emission parameter.

The described steps can be implemented in a control unit of the vehicle. This can be a central controller for all driving functions, or alternatively also one of multiple controllers which assume different functions in the control, for example, a controller or a submodule which is especially used for the exhaust gas treatment. Measurement results of the sensors can be transmitted for this purpose via wireless or wired connections to one or more controllers. The physical memory elements, in which the ring memory and/or the buffer memory are logically implemented, can be any volatile or nonvolatile memory elements and can be integrated in the controller or connected separately. The stored emission values can also be used, like the mean values calculated therefrom or the results of the check of the mean values, in further models and calculations, stored for later use, or passed on to another unit (for example, a central controller). The described computing, storage, and checking steps can be implemented by suitable software and/or hardware, wherein parts thereof can also be provided in different modules.

It is obvious that embodiments of the invention are applicable in all vehicles having internal combustion engines, thus both in solely internal combustion engine drives and also in hybrid vehicles, which are additionally equipped with an electric motor, for example. The described steps can be applied for both gasoline and also diesel engines. In addition, the described methods are independent of the specific design of the exhaust train, such as the type and number of exhaust gas-purifying components. The described embodiments can be applied in principle even if no or few exhaust gas-purifying components are present and an emission reduction is carried out only by influencing the engine operation.

The invention claimed is:

1. A method for monitoring emissions in the exhaust gas of an internal combustion engine in a vehicle, the method comprising:

carrying out (520) multiple successive emission measurements for at least one component in the exhaust gas, wherein each of the emission measurements is performed after a driving distance of predetermined length is covered by the vehicle;

storing (540) a distance-related emission value ($E_i$), which was obtained (530) on the basis of the measurement, for each of the emission measurements;

forming (550) a smoothed emission level for a current point in time on the basis of several of the previously stored distance-related emission values, wherein a memory structure (200, 400) having a fixed number of data elements (210, 410) is used to store the emission values, and wherein, if all data elements (210, 410) are occupied, upon the storage of a new emission value, the respective oldest emission value in the memory structure is overwritten;

checking whether the smoothed emission level exceeds a predetermined threshold value; and when the smoothed emission level exceeds a predetermined threshold value, copying the oldest emission value in the memory structure (400) into an additional buffer memory (440) before storing a new emission value, wherein more recent emission values are taken into consideration more strongly than emission values lying farther back in time in the formation of the smoothed emission level, and emission values from the buffer memory (440) are also used in addition in the formation of a smoothed emission level for a current point in time.

2. The method according to claim 1, wherein a new smoothed emission level for the current point in time is formed (550) after each emission measurement (520).

3. The method according to claim 1, wherein the formation (550) of the smoothed emission level includes the formation of a moving weighted mean value from a predetermined number of most recently stored distance-related emission values.

4. The method according to claim 3, wherein all of the predetermined number of emission values are weighted equally in the formation of the moving weighted mean value.

5. The method according to claim 3, wherein more recent emission values are weighted with a greater weighting factor than older emission values in the formation of the moving weighted mean value.

6. The method according to claim 1, wherein the formation of a smoothed emission value for the current point in time includes the application of an exponential smoothing to the stored emission values.

7. The method according to claim 6, wherein multiple smoothed emission levels are formed for multiple points in time, and wherein the smoothed emission level for a current point in time is calculated on the basis of the most recent emission value and a smoothed emission level for an earlier point in time.

8. The method according to claim 1, wherein the fixed number of the data elements (210, 410) in the memory structure (200, 400) is greater than or equal to a number of stored emission values, from which the smoothed emission level is formed for a current point in time.

9. The method according to claim 1, wherein the emission measurement includes the measurement of a concentration or an amount in the exhaust gas of at least one of the following components: nitrogen oxides, ammonia, carbon monoxide, particles.

10. A non-transitory computer readable medium storing instructions that, when executed by a computing unit (40), cause the computing unit (40) to perform a set of operations for monitoring an exhaust system of a vehicle, the set of operations comprising:

carrying out (520) multiple successive emission measurements for at least one component in the exhaust gas, wherein each of the emission measurements is performed after a driving distance of predetermined length is covered by the vehicle;

storing (540) a distance-related emission value ($E_i$), which was obtained (530) on the basis of the measurement, for each of the emission measurements;

forming (550) a smoothed emission level for a current point in time on the basis of several previously stored distance-related emission values, wherein a memory structure (200, 400) having a fixed number of data elements (210, 410) is used to store the emission values, and wherein, if all data elements (210, 410) are occupied, upon the storage of a new emission value, the respective oldest emission value in the memory structure is overwritten;

checking whether the smoothed emission level exceeds a predetermined threshold value; and when the smoothed emission level exceeds a predetermined threshold value, copying the oldest emission value in the memory structure (400) into an additional buffer memory (440) before storing a new emission value, wherein more recent emission values are taken into consideration more strongly than emission values lying farther back in time in the formation of the smoothed emission level, and emission values from the buffer memory (440) are also used in addition in the formation of a smoothed emission level for a current point in time.

11. The non-transitory computer readable medium according to claim 10, wherein a new smoothed emission level for the current point in time is formed (550) after each emission measurement (520).

12. The non-transitory computer readable medium according to claim 10, wherein the formation (550) of the smoothed emission level includes the formation of a moving weighted mean value from a predetermined number of most recently stored distance-related emission values.

13. The non-transitory computer readable medium according to claim 12, wherein all of the predetermined number of emission values are weighted equally in the formation of the moving weighted mean value.

14. The non-transitory computer readable medium according to claim 12, wherein more recent emission values are weighted with a greater weighting factor than older emission values in the formation of the moving weighted mean value.

15. The non-transitory computer readable medium according to claim 10, wherein the formation of a smoothed emission value for the current point in time includes the application of an exponential smoothing to the stored emission values.

16. The non-transitory computer readable medium according to claim 15, wherein multiple smoothed emission levels are formed for multiple points in time, and wherein the smoothed emission level for a current point in time is calculated on the basis of the most recent emission value and a smoothed emission level for an earlier point in time.

17. The non-transitory computer readable medium according to claim 10, wherein the fixed number of the data elements (210, 410) in the memory structure (200, 400) is greater than or equal to a number of stored emission values, from which the smoothed emission level is formed for a current point in time.

18. The non-transitory computer readable medium according to claim 10, wherein the emission measurement includes the measurement of a concentration or an amount in the exhaust gas of at least one of the following components: nitrogen oxides, ammonia, carbon monoxide, particles.

* * * * *